US008452606B2

(12) United States Patent
Vos et al.

(10) Patent No.: US 8,452,606 B2
(45) Date of Patent: May 28, 2013

(54) SPEECH ENCODING USING MULTIPLE BIT RATES

(75) Inventors: Koen Bernard Vos, San Francisco, CA (US); Søren Skak Jensen, Malmö (SE)

(73) Assignee: Skype, Dublin (IE)

( * ) Notice: Subject to any disclaimer, the term of this patent is extended or adjusted under 35 U.S.C. 154(b) by 697 days.

(21) Appl. No.: 12/586,915

(22) Filed: Sep. 29, 2009

(65) Prior Publication Data

US 2011/0077940 A1 Mar. 31, 2011

(51) Int. Cl.
*G10L 19/02* (2006.01)

(52) U.S. Cl.
USPC ..... 704/500

(58) Field of Classification Search
USPC ..... 704/500, 229, 226
See application file for complete search history.

(56) References Cited

U.S. PATENT DOCUMENTS

| | | | | |
|---|---|---|---|---|
| 4,857,927 | A | 8/1989 | Takabayashi | |
| 5,125,030 | A | 6/1992 | Nomura et al. | |
| 5,240,386 | A | 8/1993 | Amin et al. | |
| 5,253,269 | A | 10/1993 | Gerson et al. | |
| 5,327,250 | A | 7/1994 | Ikeda | |
| 5,357,252 | A | 10/1994 | Ledzius et al. | |
| 5,487,086 | A | 1/1996 | Bhaskar | |
| 5,646,961 | A | 7/1997 | Shoham et al. | |
| 5,649,054 | A | 7/1997 | Oomen et al. | |
| 5,680,508 | A | 10/1997 | Liu | |
| 5,699,382 | A | 12/1997 | Shoham et al. | |
| 5,774,842 | A | 6/1998 | Nishio et al. | |
| 5,867,814 | A | 2/1999 | Yong | |
| 6,104,992 | A | 8/2000 | Gao et al. | |
| 6,122,608 | A | 9/2000 | McCree | |
| 6,173,257 | B1 | 1/2001 | Gao | |
| 6,188,980 | B1 | 2/2001 | Thyssen | |
| 6,260,010 | B1 | 7/2001 | Gao et al. | |
| 6,363,119 | B1 * | 3/2002 | Oami | 375/240.03 |
| 6,408,268 | B1 | 6/2002 | Tasaki | |

(Continued)

FOREIGN PATENT DOCUMENTS

| | | |
|---|---|---|
| CN | 1255226 | 5/2000 |
| CN | 1337042 | 2/2002 |

(Continued)

OTHER PUBLICATIONS

"Coding of Speech at 8 kbit/s Using Conjugate-Structure Algebraic-Code-Excited Linear-Prediction (CS-ACELP)", *International Telecommunication Union, ITUT*, (1996), 39 pages.

(Continued)

*Primary Examiner* — Jakieda Jackson
(74) *Attorney, Agent, or Firm* — Wolfe-SBMC

(57) ABSTRACT

A method system and program for encoding and decoding a speech signal including error correction data. The method comprises: receiving a speech signal comprising successive frames, for each of a plurality of frames of the speech signal, analysing the speech signal to determine side information and a residual signal, encoding the residual signal at a first bit rate, and generating an output bitstream based on the residual signal encoded at the first bit rate, and for at least one of the plurality of frames of the speech signal, encoding the residual signal at a second bit rate that is lower than the first bit rate; and generating error correction data based on the residual signal encoded at the second bit rate.

25 Claims, 7 Drawing Sheets

U.S. PATENT DOCUMENTS

| | | | | |
|---|---|---|---|---|
| 6,456,964 | B2 | 9/2002 | Manjunath et al. | |
| 6,470,309 | B1 | 10/2002 | McCree | |
| 6,493,665 | B1 | 12/2002 | Su et al. | |
| 6,502,069 | B1 | 12/2002 | Grill et al. | |
| 6,523,002 | B1 | 2/2003 | Gao et al. | |
| 6,574,593 | B1 | 6/2003 | Gao et al. | |
| 6,751,587 | B2 | 6/2004 | Thyssen et al. | |
| 6,757,649 | B1 | 6/2004 | Gao et al. | |
| 6,757,654 | B1 | 6/2004 | Westerlund et al. | |
| 6,775,649 | B1 | 8/2004 | DeMartin | |
| 6,862,567 | B1 | 3/2005 | Gao | |
| 6,996,523 | B1 | 2/2006 | Bhaskar et al. | |
| 7,136,812 | B2 | 11/2006 | Manjunath et al. | |
| 7,149,683 | B2 | 12/2006 | Jelinek | |
| 7,151,802 | B1 | 12/2006 | Bessette et al. | |
| 7,171,355 | B1 | 1/2007 | Chen | |
| 7,496,505 | B2 | 2/2009 | Manjunath et al. | |
| 7,505,594 | B2 | 3/2009 | Mauro | |
| 7,684,981 | B2 | 3/2010 | Thumpudi et al. | |
| 7,869,993 | B2 | 1/2011 | Ojala | |
| 7,873,511 | B2 | 1/2011 | Herre et al. | |
| 8,036,887 | B2 | 10/2011 | Yasunaga et al. | |
| 8,069,040 | B2 | 11/2011 | Vos | |
| 8,078,474 | B2 | 12/2011 | Vos et al. | |
| 8,392,178 | B2 | 3/2013 | Vos | |
| 8,396,706 | B2 | 3/2013 | Vos | |
| 8,433,563 | | 4/2013 | Vos | |
| 2001/0001320 | A1 | 5/2001 | Heinen et al. | |
| 2001/0005822 | A1 | 6/2001 | Fujii et al. | |
| 2001/0039491 | A1 | 11/2001 | Yasunaga et al. | |
| 2002/0032571 | A1 | 3/2002 | Leung et al. | |
| 2002/0099540 | A1 | 7/2002 | Yasunaga et al. | |
| 2002/0120438 | A1 | 8/2002 | Lin | |
| 2003/0200092 | A1 | 10/2003 | Gao et al. | |
| 2004/0102969 | A1 | 5/2004 | Manjunath et al. | |
| 2005/0141721 | A1* | 6/2005 | Aarts et al. | 381/16 |
| 2005/0278169 | A1* | 12/2005 | Hardwick | 704/223 |
| 2005/0285765 | A1 | 12/2005 | Suzuki et al. | |
| 2006/0074643 | A1 | 4/2006 | Lee et al. | |
| 2006/0235682 | A1 | 10/2006 | Yasunaga et al. | |
| 2006/0271356 | A1 | 11/2006 | Vos | |
| 2007/0043560 | A1 | 2/2007 | Lee | |
| 2007/0055503 | A1 | 3/2007 | Chu et al. | |
| 2007/0088543 | A1 | 4/2007 | Ehara | |
| 2007/0100613 | A1 | 5/2007 | Yasunaga et al. | |
| 2007/0136057 | A1 | 6/2007 | Phillips | |
| 2007/0225971 | A1 | 9/2007 | Bessette | |
| 2007/0255561 | A1 | 11/2007 | Su et al. | |
| 2008/0004869 | A1 | 1/2008 | Herre et al. | |
| 2008/0015866 | A1 | 1/2008 | Thyssen et al. | |
| 2008/0091418 | A1 | 4/2008 | Laaksonen et al. | |
| 2008/0126084 | A1 | 5/2008 | Lee et al. | |
| 2008/0140426 | A1* | 6/2008 | Kim et al. | 704/500 |
| 2008/0154588 | A1 | 6/2008 | Gao | |
| 2008/0275698 | A1 | 11/2008 | Yasunaga et al. | |
| 2009/0043574 | A1 | 2/2009 | Gao et al. | |
| 2009/0222273 | A1 | 9/2009 | Massaloux et al. | |
| 2010/0174531 | A1 | 7/2010 | Bernard | |
| 2010/0174532 | A1 | 7/2010 | Vos et al. | |
| 2010/0174534 | A1 | 7/2010 | Vos | |
| 2010/0174542 | A1 | 7/2010 | Vos | |
| 2010/0174547 | A1 | 7/2010 | Vos | |
| 2011/0077940 | A1 | 3/2011 | Vos et al. | |
| 2011/0173004 | A1 | 7/2011 | Bessette et al. | |

FOREIGN PATENT DOCUMENTS

| | | |
|---|---|---|
| CN | 1653521 | 8/2005 |
| EP | 0501421 | 9/1992 |
| EP | 0550990 | 7/1993 |
| EP | 0610906 | 8/1994 |
| EP | 0720145 | 7/1996 |
| EP | 0724252 | 7/1996 |
| EP | 0849724 | 6/1998 |
| EP | 0877355 | 11/1998 |
| EP | 0957472 | 11/1999 |
| EP | 1093116 | 4/2001 |
| EP | 1255244 | 11/2002 |
| EP | 1326235 | 7/2003 |
| EP | 1758101 | 2/2007 |
| EP | 1903558 | 3/2008 |
| GB | 2466669 | 7/2010 |
| GB | 2466670 | 7/2010 |
| GB | 2466671 | 7/2010 |
| GB | 2466672 | 7/2010 |
| GB | 2466673 | 7/2010 |
| GB | 2466674 | 7/2010 |
| GB | 2466675 | 7/2010 |
| JP | 1205638 | 10/1987 |
| JP | 2287400 | 4/1989 |
| JP | 4312000 | 4/1991 |
| JP | 7306699 | 5/1994 |
| JP | 2007279754 | 10/2007 |
| WO | WO-9103790 | 3/1991 |
| WO | WO-9403988 | 2/1994 |
| WO | WO-9518523 | 7/1995 |
| WO | WO-9918565 | 4/1999 |
| WO | WO-9963521 | 12/1999 |
| WO | WO-0103122 | 1/2001 |
| WO | WO-0191112 | 11/2001 |
| WO | WO-03052744 | 6/2003 |
| WO | WO-2005009019 | 1/2005 |
| WO | WO-2008046492 | 4/2008 |
| WO | WO-2008056775 | 5/2008 |
| WO | WO-2010079163 | 7/2010 |
| WO | WO-2010079164 | 7/2010 |
| WO | WO-2010079165 | 7/2010 |
| WO | WO-2010079166 | 7/2010 |
| WO | WO-2010079167 | 7/2010 |
| WO | WO-2010079170 | 7/2010 |
| WO | WO-2010079171 | 7/2010 |

OTHER PUBLICATIONS

"Final Office Action", U.S. Appl. No. 12/455,478, (Jun. 28, 2012), 8 pages.
"International Search Report and Written Opinion", Application No. PCT/EP2010/050060, (Apr. 14, 2010), 14 pages.
"International Search Report and Written Opinion", Application No. PCT/EP2010/050052, (Jun. 21, 2010), 13 pages.
"International Search Report and Written Opinion", Application No. PCT/EP2010/050057, (Jun. 24, 2010), 11 pages.
"International Search Report and Written Opinion", Application No. PCT/EP2010/050053, (May 17, 2010), 17 pages.
"International Search Report and Written Opinion", Application No. PCT/EP2010/050061, (Apr. 12, 2010), 13 pages.
"International Search Report and Written Opinion", Application No. PCT/EP2010/050051, (Mar. 15, 2010), 13 pages.
"International Search Report and Written Opinion", Application No. PCT/EP2010/050056, (Mar. 29, 2010), 8 pages.
"Non-Final Office Action", U.S. Appl. No. 12/455,100, (Jun. 8, 2012), 8 pages.
"Non-Final Office Action", U.S. Appl. No. 12/455,632, (Oct. 18, 2011), 14 pages.
"Non-Final Office Action", U.S. Appl. No. 12/455,632, (Feb. 6, 2012), 18 pages.
"Non-Final Office Action", U.S. Appl. No. 12/455,712, (Jun. 20, 2012), 8 pages.
"Non-Final Office Action", U.S. Appl. No. 12/455,752, (Jun. 15, 2012), 8 pages.
"Notice of Allowance", U.S. Appl. No. 12/455,632, (May 15, 2012), 7 pages.
"Search Report", Application No. GB 0900139.7, (Apr. 17, 2009), 3 pages.
"Search Report", Application No. GB 0900141.3, (Apr. 30, 2009), 3 pages.
"Search Report", Application No. GB 0900142.1, (Apr. 21, 2009), 2 pages.
"Search Report", Application No. GB 0900144.7, (Apr. 24, 2009), 2 pages.
"Search Report", Application No. GB0900143.9, (Apr. 28, 2009), 1 page.
"Search Report", Application No. GB0900145.4, (Apr. 27, 2009), 1 page.

"Wideband Coding of Speech at Around 1 kbit/sUsing Adaptive Multi-rate Wideband (AMR-WB)", *International Telecommunication Union G.722.2*, (2002), pp. 1-65.
Bishnu, S et al., "Predictive Coding of Speech Signals and Error Criteria", *IEEE, Transactions on Acoustics, Speech and Signal Processing, ASSP* 27(3), (1979), pp. 247-254.
Chen, Juin-Hwey "Novel Codec Structures for Noise Feedback Coding of Speech", IEEE (2006), pp. 681-684.
Chen, L "Subframe Interpolation Optimized Coding of LSF Parameters", *IEEE*, (Jul. 2007), pp. 725-728.
Denckla, Ben "Subtractive Dither for Internet Audio", *Journal of the Audio Engineering Society*, vol. 46, Issue 7/8, (Jul. 1998), pp. 654-656.
Ferreira, C R., et al., "Modified Interpolation of LSFs Based on Optimization of Distortion Measures", *IEEE*, (Sep. 2006), pp. 777-782.
Gerzon, et al., "A High-Rate Buried-Data Channel for Audio CD", Journal of Audio Engineering Society, vol. 43, No. 1/2,(Jan. 1995), 22 pages.
Haagen, J et al., "Improvements in 2.4 KBPS High-Quality Speech Coding", *IEEE*, (Mar. 1992), pp. 145-148.
Islam, T et al., "Partial-Energy Weighted Interpolation of Linear Prediction Coefficients", *IEEE*, (Sep. 2000), pp. 105-107.
Jayant, N S., et al., "The Application of Dither to the Quantization of Speech Signals", *Program of the 84th Meeting of the Acoustical Society of America*. (Abstract Only), (Nov.-Dec. 1972), pp. 1293-1304.
Lupini, Peter et al., "A Multi-Mode Variable Rate Celp Coder Based on Frame Classification", *Proceedings of the International Conference on Communications* (*ICC*) *IEEE 1*, (1993), pp. 406-409.
Mahe, G et al., "Quantization Noise Spectral Shaping in Instantaneous Coding of Spectrally Unbalanced Speech Signals", *IEEE, Speech Coding Workshop*, (2002), pp. 56-58.
Makhoul, John et al., "Adaptive Noise Spectral Shaping and Entropy Coding of Speech", (Feb. 1979), pp. 63-73.
Martins Da Silva, L et al., "Interpolation-Based Differential Vector Coding of Speech LSF Parameters", *IEEE*, (Nov. 1996), pp. 2049-2052.
Rao, A V., et al., "Pitch Adaptive Windows for Improved Excitation Coding in Low-Rate CELP Coders", *IEEE Transactions on Speech and Audio Processing*, (Nov. 2003), pp. 648-659.
Salami, R "Design and Description of CS-ACELP: A Toll Quality 8 kb/s Speech Coder", *IEEE*, 6(2), (Mar. 1998), pp. 116-130.
"Examination Report under Section 18(3)", Great Britain Application No. 0900143.9, (May 21, 2012), 2 pages.
"Examination Report", *GB Application No. 0900139.7*, (Aug. 28, 2012), 1 page.
"Examination Report", GB Application No. 0900141.3, (Oct. 8, 2012), 2 pages.
"Final Office Action", U.S. Appl. No. 12/455,100, (Oct. 4, 2012), 5 pages.
"Final Office Action", U.S. Appl. No. 12/455,752, (Nov. 23, 2012), 8 pages.
"Foreign Office Action", Great Britain Application No. 0900145.4, (May 28, 2012), 2 pages.
"Non-Final Office Action", U.S. Appl. No. 12/455,157, (Aug. 6, 2012), 15 pages.
"Non-Final Office Action", U.S. Appl. No. 12/455,632, (Aug. 22, 2012), 14 pages.
"Non-Final Office Action", U.S. Appl. No. 12/583,998, (Oct. 18, 2012), 16 pages.
"Notice of Allowance", U.S. Appl. No. 12/455,157, (Nov. 29, 2012), 9 pages.
"Notice of Allowance", U.S. Appl. No. 12/455,478, (Dec. 7, 2012), 7 pages.
"Notice of Allowance", U.S. Appl. No. 12/455,712, (Oct. 23, 2012), 7 pages.
"Supplemental Notice of Allowance", U.S. Appl. No. 12/455,712, (Dec. 19, 2012), 2 pages.
"Final Office Action", U.S. Appl. No. 12/455,632, (Jan. 18, 2013), 15 pages.
"Foreign Office Action", CN Application No. 201080010208.1, (Dec. 28, 2012), 12 pages.
"Notice of Allowance", U.S. Appl. No. 12/455,100, (Feb. 5, 2013), 4 Pages.
"Supplemental Notice of Allowance", U.S. Appl. No. 12/455,157, (Jan. 22, 2013), 2 pages.
"Supplemental Notice of Allowance", U.S. Appl. No. 12/455,157, (Feb. 8, 2013), 2 pages.
"Supplemental Notice of Allowance", U.S. Appl. No. 12/455,478, (Jan. 11, 2013), 2 pages.
"Supplemental Notice of Allowance", U.S. Appl. No. 12/455,712, (Jan. 14, 2013), 2 pages.
"Supplemental Notice of Allowance", U.S. Appl. No. 12/455,712, (Feb. 5, 2013), 2 pages.
"Foreign Office Action", Chinese Application No. 201080010209, (Jan. 30, 2013), 12 pages.
"Supplemental Notice of Allowance", U.S. Appl. No. 12/455,100, (Apr. 4, 2013), 2 pages.
"Supplemental Notice of Allowance", U.S. Appl. No. 12/455,478, (Mar. 28, 2013), 3 pages.

* cited by examiner

SPEECH ENCODING USING MULTIPLE BIT RATES

TECHNICAL FIELD

The present invention relates to the encoding of speech for transmission over a transmission medium, such as by means of an electronic signal over a wired connection or electromagnetic signal over a wireless connection.

BACKGROUND

A source-filter model of speech is illustrated schematically in FIG. 1*a*. As shown, speech can be modelled as comprising a signal from a source 102 passed through a time-varying filter 104. The source signal represents the immediate vibration of the vocal chords, and the filter represents the acoustic effect of the vocal tract formed by the shape of the throat, mouth and tongue. The effect of the filter is to alter the frequency profile of the source signal so as to emphasise or diminish certain frequencies. Instead of trying to directly represent an actual waveform, speech encoding works by representing the speech using parameters of a source-filter model.

As illustrated schematically in FIG. 1*b*, the encoded signal will be divided into a plurality of frames 106, with each frame comprising a plurality of subframes 108. For example, speech may be sampled at 16 kHz and processed in frames of 20 ms, with some of the processing done in subframes of 5 ms (four subframes per frame). Each frame comprises a flag 107 by which it is classed according to its respective type. Each frame is thus classed at least as either "voiced" or "unvoiced", and unvoiced frames are encoded differently than voiced frames. Each subframe 108 then comprises a set of parameters of the source-filter model representative of the sound of the speech in that subframe.

For voiced sounds (e.g. vowel sounds), the source signal has a degree of long-term periodicity corresponding to the perceived pitch of the voice. In that case, the source signal can be modelled as comprising a quasi-periodic signal with each period comprising a series of pulses of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. An example of a modelled source signal 202 is shown schematically in FIG. 2*a* with a gradually varying period $P_1$, $P_2$, $P_3$, etc., each comprising four pulses which may vary gradually in form and amplitude from one period to the next.

According to many speech coding algorithms such as those using Linear Predictive Coding (LPC), a short-term filter is used to separate out the speech signal into two separate components: (i) a signal representative of the effect of the time-varying filter 104; and (ii) the remaining signal with the effect of the filter 104 removed, which is representative of the source signal. The signal representative of the effect of the filter 104 may be referred to as the spectral envelope signal, and typically comprises a series of sets of LPC parameters describing the spectral envelope at each stage. FIG. 2*b* shows a schematic example of a sequence of spectral envelopes $\mathbf{204}_1$, $\mathbf{204}_2$, $\mathbf{204}_3$, etc. varying over time. Once the varying spectral envelope is removed, the remaining signal representative of the source alone may be referred to as the LPC residual signal, as shown schematically in FIG. 2*a*.

The spectral envelope signal and the source signal are each encoded separately for transmission. In the illustrated example, each subframe 106 would contain: (i) a set of parameters representing the spectral envelope 204; and (ii) a set of parameters representing the pulses of the source signal 202.

In the illustrated example, each subframe 106 would comprise: (i) a quantised set of LPC parameters representing the spectral envelope, (ii)(a) a quantised LTP vector related to the correlation between pitch-periods in the source signal, and (ii)(b) a quantised LTP residual signal representative of the source signal with the effects of both the inter-period correlation and the spectral envelope removed.

The residual signal comprises information present in the original input speech signal that is not represented by the quantized LPC parameters and LTP vector. This information must be encoded and sent with the LPC and LTP parameters in order to allow the encoded speech signal to be accurately synthesized at the decoder.

It is common to provide forward error correction when transmitting packetized data over a lossy channel. FEC adds information about the content of a previous packet to the current packet. If that previous packet is received, the primary information it contains is used for decoding an output signal. If, on the other hand, the previous packet was lost, then the FEC information in the current packet can be used to update the state of the decoder and to decode an output signal for the lost packet.

Forward error correction FEC can roughly be divided into two categories, media specific and media independent FEC. Media independent FEC works by adding redundancy to the bits of two or more payloads. One example of this is simply XORing multiple payloads to create the redundant information. If any of the payloads is lost, then the XORed information together with the other payloads can be used to recreate the lost payload. Reed Solomon Coding is another example of media independent FEC. In the case of media independent FEC no re-encoding of the signal takes place.

Media dependent FEC includes methods where a lower bitrate speech coder is used to generate the redundant information through a process of re-encoding the signal. The redundant information is piggy backed to other packets. Also this is sometimes called low bit rate redundancy LBRR. For example, see IETF RFC 2354, and RFC 2198.

In order for FEC to work it is important that the bit rate can be controlled. For media independent FEC this can be achieved by increasing the delay and XORing more packets together. However, for real time communication increasing the delay is not a desirable solution. Also in combination with a variable bit rate speech coder the XORing FEC has a deficiency because the size of the redundant information block is determined by the largest payload used in the XORing process. Further more, the length has to be sent as side information, thus creating extra overhead.

When another, lower bit rate, speech coder is used to generate the redundant information, the bit rate can be controlled as long as there are coders operating at different rates available. The drawback of this solution is that the two encoders need to be operating in parallel which results in a large complexity increase. Low bit rate speech coders often exploit long term correlation to encode the signal efficiently, which means that the encoder/decoder states needs to be in sync for correct decoding. This also means an increased complexity on the decoder side as two decoders are required operating in parallel.

It is an aim of some embodiments of the present invention to address, or at least mitigate, some of the above identified problems of the prior art.

SUMMARY

According to one aspect of the present invention, there is provided a method of providing error correction data for encoding a speech signal, the method comprising: receiving a speech signal comprising successive frames; for each of a plurality of frames of the speech signal: analysing the speech signal to determine side information and a residual signal; encoding the residual signal at a first bit rate, and generating an output bitstream based on the residual signal encoded at the first bit rate; and for at least one of the plurality of frames of the speech signal, encoding the residual signal at a second bit rate that is lower than the first bit rate; and generating error correction data based on the residual signal encoded at the second bit rate.

In embodiments, the output bitstream may further be based on the side information.

The error correction data may further be based on the side information.

The method may further comprise generating an error correction bitstream based on the error correction data.

The method may further comprise buffering the error correction bitstream, such that the error correction bit stream is delayed relative to the output bitstream.

The error correction bitstream may be delayed by one of one packet or two packets of the output bitstream.

The delayed error correction bitstream may be multiplexed with the output bitstream prior to transmission.

The method may further comprise setting a flag for at least one frame of the speech signal, the flag indicating whether error correction data has been generated for that frame, the flag further indicating whether the error correction bit stream has been delayed by one or two packets.

The method may further comprise, for each frame of the speech signal, determining the sensitivity of the frame to packet losses, and generating error correction data in dependence on the determination.

Said determining may comprise determining the sensitivity of the frame to packet losses based on a voice activity measure.

Said determining may comprise determining the sensitivity of the frame to packet losses based on a long-term prediction sensitivity measure.

If the frame is determined not to be sensitive to packet losses, the generating of the error correction data may be bypassed.

The method may further comprise controlling the quantization gain used to encode the residual information at the second bit rate in order to control the second bit rate.

According to another aspect of the present invention, there is provided a method of decoding a packetized encoded bitstream comprising an output bitstream and error correction data, the output bitstream representing a speech signal and comprising a residual signal encoded at a first rate, the error correction data comprising the residual signal encoded at a second rate lower than the first rate, the method comprising: receiving the bitstream and decoding the speech signal; when it is determined that a packet of the bitstream has been lost, determining whether error correction data for the lost packet is present in a further packet of the bitstream, and if so decoding the error correction data in the decoder.

In embodiments, this method may further comprise decoding a flag in a packet of the received bit stream, the flag indicating that the packet contains error correction data for a lost packet.

According to another aspect of the present invention, there may be provided an encoder for encoding a speech signal including error correction data, the encoder comprising: an input arranged to receive a speech signal comprising successive frames; a first signal-processing module configured to encode a residual signal at a first bit rate; a first arithmetic encoder configured to generate an output bitstream based on the residual signal encoded at the first bit rate; and a second signal-processing module configured to encode the residual signal at a second bit rate that is lower than the first bit rate and to generate error correction data based on the residual signal encoded at the second bit rate.

In embodiments, the encoder may further comprise a second arithmetic encoder configured to generate an error correction bitstream based on the error correction data.

The encoder may further comprise a buffer configured to delay the error correction bitstream relative to the output bit stream.

The buffer may be configured to delay the error correction bitstream by one of one or two packets of the output bitstream.

The encoder may further comprise a gain adjustment module configured to control the quantization gain used to encode the residual information at the second bit rate to thereby control the second bit rate.

The second signal-processing module may be further configured to, for each frame of a speech signal, determine the sensitivity of the frame to packet losses and to generate error correction data in dependence on the determined sensitivity.

According to another aspect of the present invention, there may be provided a decoder for decoding a packetized encoded bitstream comprising an output bitstream and error correction data, the output bitstream representing a speech signal and comprising a residual signal encoded at a first rate, the error correction data comprising the residual signal encoded at a second rate lower than the first rate, the decoder comprising: an input module configured to receive the packetized bitstream and extract the output bitstream, the input module further configured to detect if a packet of the packetized bitstream has been lost, and if so to determine whether error correction data for the lost packet is present in a further packet of the packetized bitstream; and a signal-processing module configured to decode the speech signal from the output bitstream, the signal-processing module further configured to decode error correction data for a lost packet if it is determined that error correction data is present.

In embodiments, the input module may be further configured to, for each packet of the packetized bit stream, decode a flag indicating whether the packet contains error correction data for a lost packet.

According to another aspect of the present invention, there is provided a computer program product for providing error correction data for encoding a speech signal, the program comprising code embodied on a computer-readable medium and configured so as when executed on a processor to: receive a speech signal comprising successive frames; for each of a plurality of frames of the speech signal: analyse the speech signal to determine side information and a residual signal; encode the residual signal at a first bit rate, and generate an output bitstream based on the residual signal encoded at the first bit rate; and for at least one of the plurality of frames of the speech signal, encode the residual signal at a second bit rate that is lower than the first bit rate; and generate error correction data based on the residual signal encoded at the second bit rate.

In embodiments, the program may be further configured in accordance with any of the above method features.

According to another aspect of the present invention, there may be provided a communication system comprising a plurality of end-user terminals, each of the end-user terminals comprising at least one of an encoder and a decoder. In embodiments, the encoder may have any of the above encoder features and the decoder may have any of the above decoder features.

BRIEF DESCRIPTION OF THE DRAWINGS

Embodiments of the present invention will now be described by way of example only, and with reference to the accompanying figures, in which.

DETAILED DESCRIPTION

Embodiments of the invention are described herein by way of particular examples and specifically with reference to exemplary embodiments. It will be understood by one skilled in the art that the invention is not limited to the details of the specific embodiments given herein.

Embodiments of the invention provide a method of generating FEC data for a data packet, where the FEC data is generated from an intermediary result within an encoder rather than from the payload of the previously transmitted packet.

According to some embodiments, FEC data may be generated by reusing the outcome of the encoder analysis that produces the parameters for the side information, and re-quantizing the residual signal.

Figure 1A:
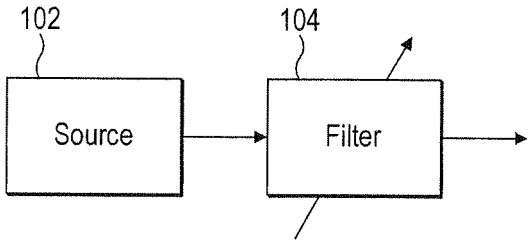
FIG. 1*a* is a schematic representation of a source-filter model of speech.
Figure 1B:
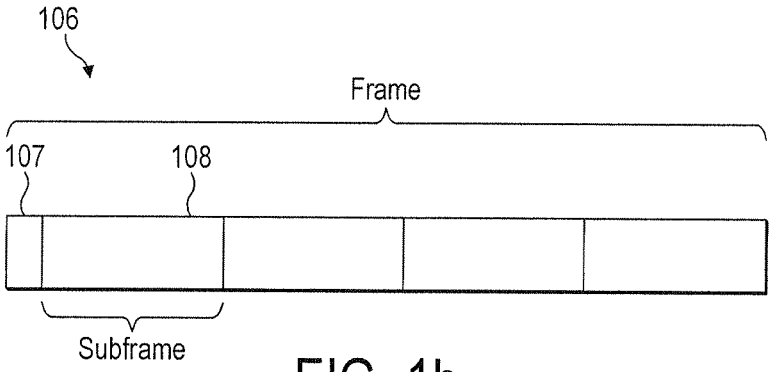
FIG. 1*b* is a schematic representation of a frame.
Figure 2A:
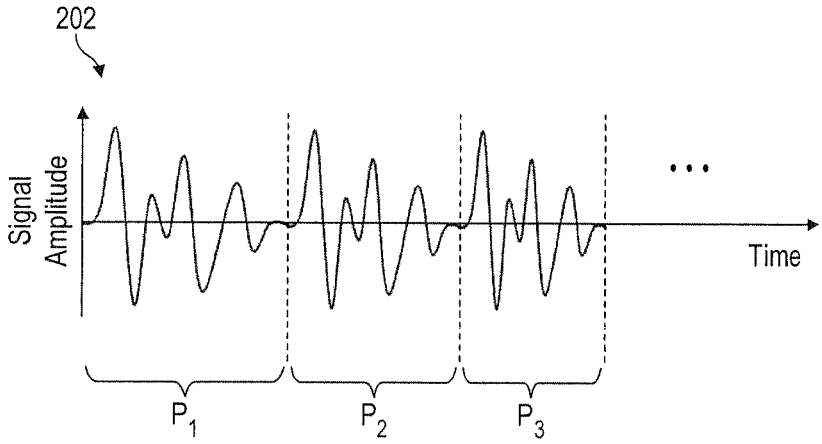
FIG. 2*a* is a schematic representation of a source signal.
Figure 2B:
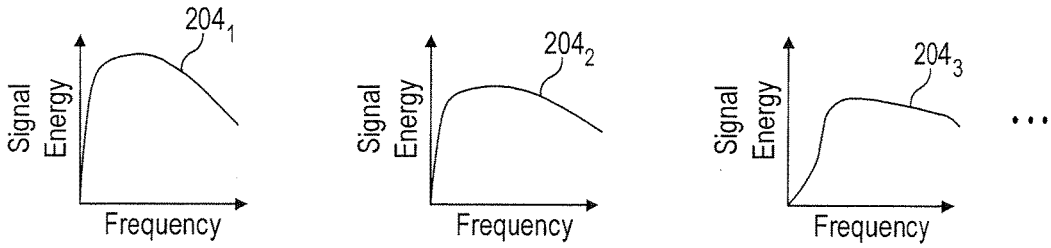
FIG. 2*b* is a schematic representation of variations in a spectral envelope.
Figure 3:
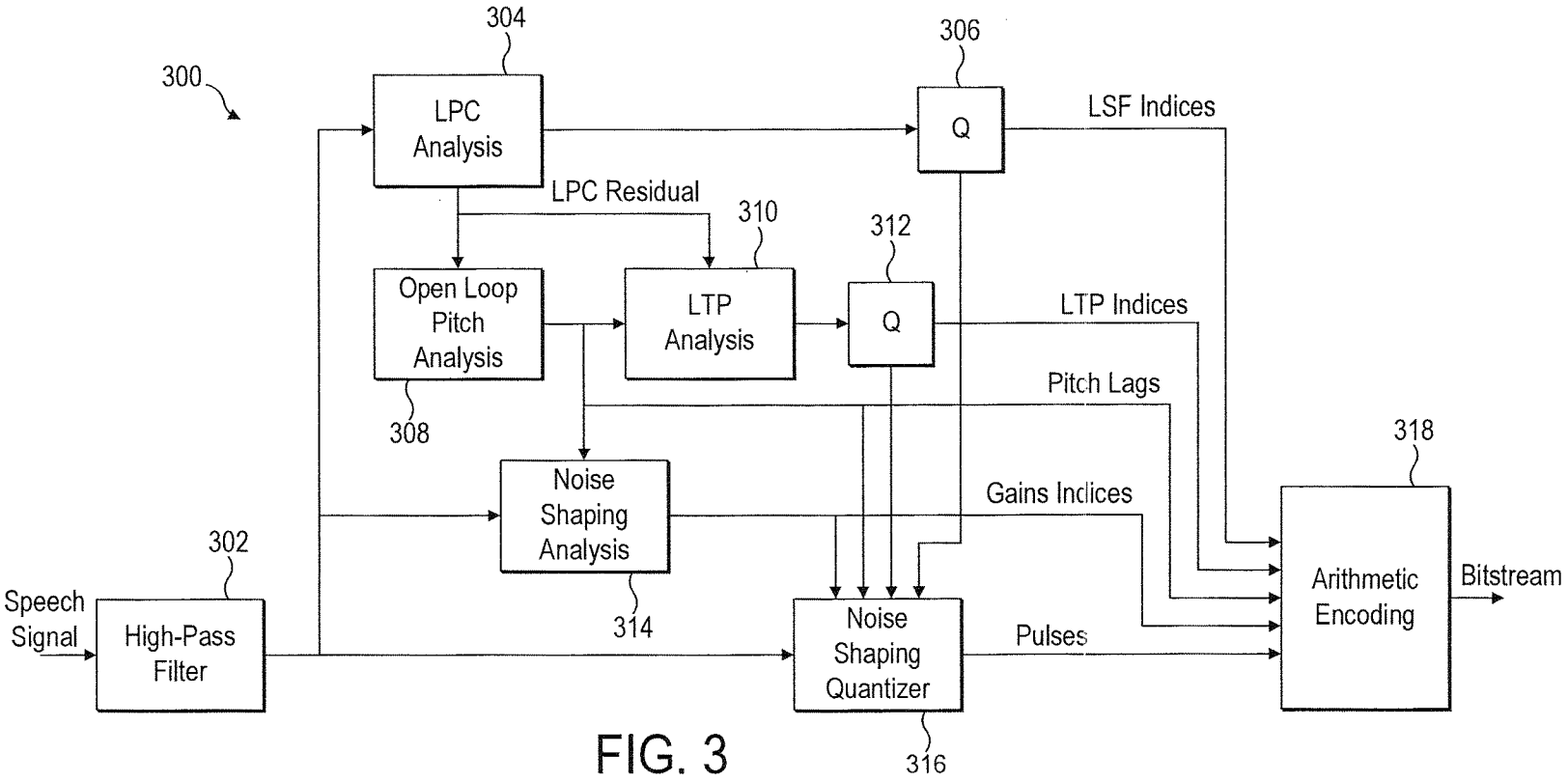
FIG. 3 shows a linear predictive speech encoder.

An example of an encoder 300 is now described in relation to FIG. 3.

The encoder 300 comprises a high-pass filter 302, a linear predictive coding (LPC) analysis block 304, a first vector quantizer 306, an open-loop pitch analysis block 308, a long-term prediction (LTP) analysis block 310, a second vector quantizer 312, a noise shaping analysis block 314, a noise shaping quantizer 316, and an arithmetic encoding block 318. The high pass filter 302 has an input arranged to receive an input speech signal from an input device such as a microphone, and an output coupled to inputs of the LPC analysis block 304, noise shaping analysis block 314 and noise shaping quantizer 316. The LPC analysis block has an output coupled to an input of the first vector quantizer 306, and the first vector quantizer 306 has outputs coupled to inputs of the arithmetic encoding block 318 and noise shaping quantizer 316. The LPC analysis block 304 has outputs coupled to inputs of the open-loop pitch analysis block 308 and the LTP analysis block 310. The LTP analysis block 310 has an output coupled to an input of the second vector quantizer 312, and the second vector quantizer 312 has outputs coupled to inputs of the arithmetic encoding block 318 and noise shaping quantizer 316. The open-loop pitch analysis block 308 has outputs coupled to inputs of the LTP 310 analysis block 310 and the noise shaping analysis block 314. The noise shaping analysis block 314 has outputs coupled to inputs of the arithmetic encoding block 318 and the noise shaping quantizer 316. The noise shaping quantizer 316 has an output coupled to an input of the arithmetic encoding block 318. The arithmetic encoding block 318 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes of 5 milliseconds. The output bitsream payload contains arithmetically encoded parameters, and has a bitrate that varies depending on a quality setting provided to the encoder and on the complexity and perceptual importance of the input signal.

The speech input signal is input to the high-pass filter 304 to remove frequencies below 80 Hz which contain almost no speech energy and may contain noise that can be detrimental to the coding efficiency and cause artifacts in the decoded output signal. The high-pass filter 304 is preferably a second order auto-regressive moving average (ARMA) filter.

The high-pass filtered input $x_{HP}$ is input to the linear prediction coding (LPC) analysis block 304, which calculates 16 LPC coefficients $a_i$ using the covariance method which minimizes the energy of the LPC residual $r_{LPC}$:

$$r_{LPC}(n) = x_{HP}(n) - \sum_{i=1}^{16} x_{HP}(n-i)a_i,$$

where n is the sample number. The LPC coefficients are used with an LPC analysis filter to create the LPC residual.

The LPC coefficients are transformed to a line spectral frequency (LSF) vector. The LSFs are quantized using the first vector quantizer 306, a multi-stage vector quantizer (MSVQ) with 10 stages, producing 10 LSF indices that together represent the quantized LSFs. The quantized LSFs are transformed back to produce the quantized LPC coefficients for use in the noise shaping quantizer 316.

The LPC residual is input to the open loop pitch analysis block 308, producing one pitch lag for every 5 millisecond subframe, i.e., four pitch lags per frame. The pitch lags are chosen between 32 and 288 samples, corresponding to pitch frequencies from 56 to 500 Hz, which covers the range found in typical speech signals. Also, the pitch analysis produces a pitch correlation value which is the normalized correlation of the signal in the current frame and the signal delayed by the pitch lag values. Frames for which the correlation value is below a threshold of 0.5 are classified as unvoiced, i.e., containing no periodic signal, whereas all other frames are classified as voiced. The pitch lags are input to the arithmetic coder 318 and noise shaping quantizer 316.

For voiced frames, a long-term prediction analysis is performed on the LPC residual. The LPC residual $r_{LPC}$ is supplied from the LPC analysis block 304 to the LTP analysis block 310. For each subframe, the LTP analysis block 310 solves normal equations to find 5 linear prediction filter coefficients $b_i$ such that the energy in the LTP residual $r_{LTP}$ for that subframe:

$$r_{LTP}(n) = r_{LPC}(n) - \sum_{i=-2}^{2} r_{LPC}(n - lag - i)b_i$$

is minimized.

The high-pass filtered input is analyzed by the noise shaping analysis block 314 to find filter coefficients and quantization gains used in the noise shaping quantizer. The filter coefficients determine the distribution over the quantization noise over the spectrum, and are chose such that the quantization is least audible. The quantization gains determine the step size of the residual quantizer and as such govern the balance between bitrate and quantization noise level.

All noise shaping parameters are computed and applied per subframe of 5 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of quantization noise which is more easily audible for voiced signals. The quantization gain for each subframe is quantized, and the quantization indices are input to the arithmetically encoder 318. The quantized quantization gains are input to the noise shaping quantizer 316.

Next a set of short-term noise shaping coefficients $a_{shape,\,i}$ are found by applying bandwidth expansion to the coefficients found in the noise shaping LPC analysis. This bandwidth expansion moves the roots of the noise shaping LPC polynomial towards the origin, according to the formula:

$$a_{shape,i} = a_{autocorr,i} g^i$$

where $a_{autocorr,\,i}$ the ith coefficient from the noise shaping LPC analysis and for the bandwidth expansion factor g a value of 0.94 was found to give good results.

For voiced frames, the noise shaping quantizer also applies long-term noise shaping. It uses three filter taps, described by:

$$b_{shape} = 0.5 sqrt(\text{PitchCorrelation})[0.25, 0.5, 0.25].$$

The short-term and long-term noise shaping coefficients are input to the noise shaping quantizer 316. The high-pass filtered input is also input to the noise shaping quantizer 316.

Figure 4:
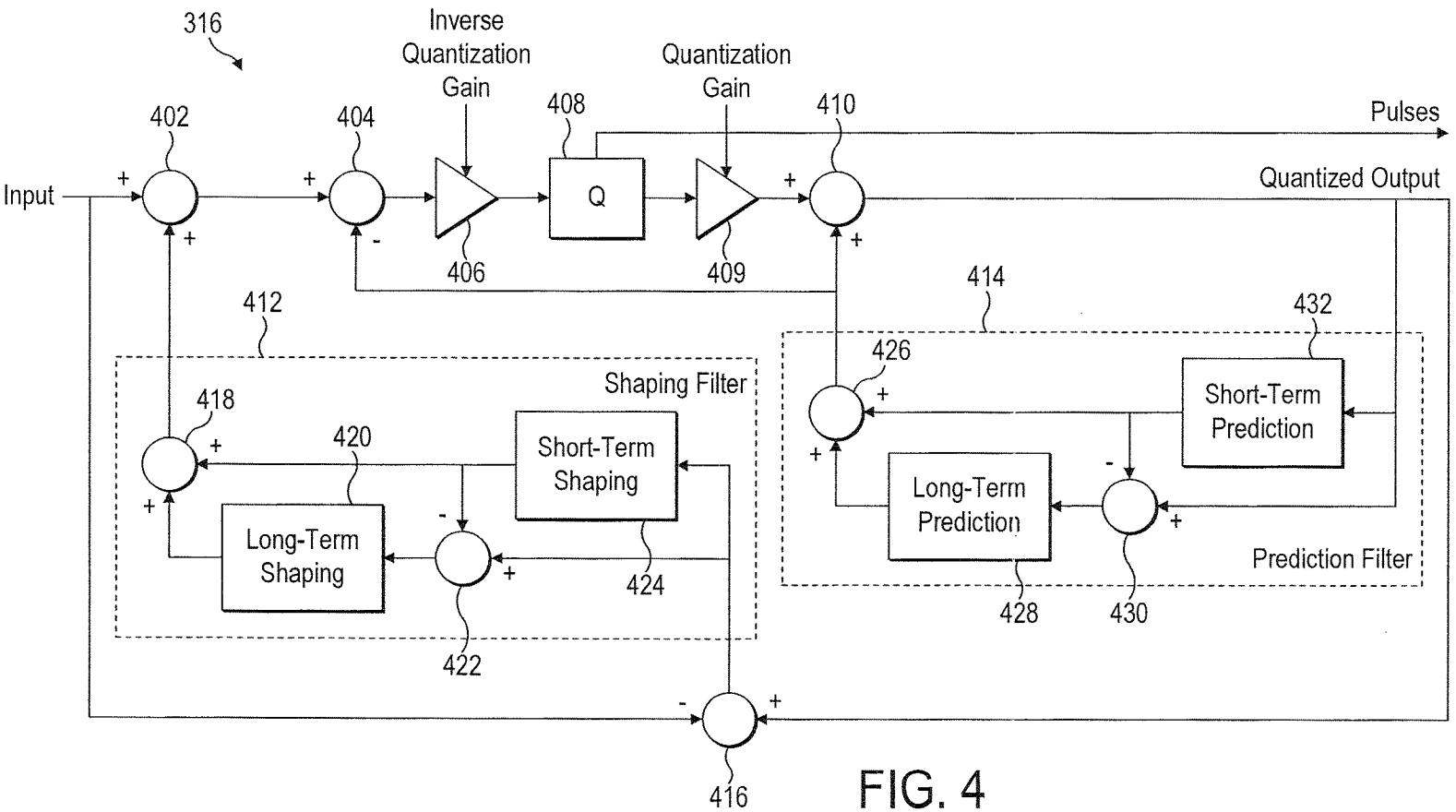
FIG. 4 shows a more detailed representation of noise shaping quantizer of FIG. 3.

An example of the noise shaping quantizer 316 is now discussed in relation to FIG. 4.

The noise shaping quantizer 316 comprises a first addition stage 402, a first subtraction stage 404, a first amplifier 406, a scalar quantizer 408, a second amplifier 409, a second addition stage 410, a shaping filter 412, a prediction filter 414 and a second subtraction stage 416. The shaping filter 412 comprises a third addition stage 418, a long-term shaping block 420, a third subtraction stage 422, and a short-term shaping block 424. The prediction filter 414 comprises a fourth addition stage 426, a long-term prediction block 428, a fourth subtraction stage 430, and a short-term prediction block 432.

The first addition stage 402 has an input arranged to receive the high-pass filtered input from the high-pass filter 302, and another input coupled to an output of the third addition stage 418. The first subtraction stage has inputs coupled to outputs of the first addition stage 402 and fourth addition stage 426. The first amplifier has a signal input coupled to an output of the first subtraction stage and an output coupled to an input of the scalar quantizer 408. The first amplifier 406 also has a control input coupled to the output of the noise shaping analysis block 314. The scalar quantizer 408 has outputs coupled to inputs of the second amplifier 409 and the arithmetic encoding block 318. The second amplifier 409 also has a control input coupled to the output of the noise shaping analysis block 314, and an output coupled to the an input of the second addition stage 410. The other input of the second addition stage 410 is coupled to an output of the fourth addition stage 426. An output of the second addition stage is coupled back to the input of the first addition stage 402, and to an input of the short-term prediction block 432 and the fourth subtraction stage 430. An output of the short-term prediction block 432 is coupled to the other input of the fourth subtraction stage 430. The output of the fourth subtraction stage 430 is coupled to the input of the long-term prediction block 428. The fourth addition stage 426 has inputs coupled to outputs of the long-term prediction block 428 and short-term prediction block 432. The output of the second addition stage 410 is further coupled to an input of the second subtraction stage 416, and the other input of the second subtraction stage 416 is coupled to the input from the high-pass filter 302. An output of the second subtraction stage 416 is coupled to inputs of the short-term shaping block 424 and the third subtraction stage 422. An output of the short-term shaping block 424 is coupled to the other input of the third subtraction stage 422. The output of third subtraction stage 422 is coupled to the input of the long-term shaping block 420. The third addition stage 418 has inputs coupled to outputs of the long-term shaping block 420 and short-term shaping block 424. The short-term and long-term shaping blocks 424 and 420 are each also coupled to the noise shaping analysis block 314, and the long-term shaping block 420 is also coupled to the open-loop pitch analysis block 308 (connections not shown). Further, the short-term prediction block 432 is coupled to the LPC analysis block 304 via the first vector quantizer 306, and the long-term prediction block 428 is coupled to the LTP analysis block 310 via the second vector quantizer 312 (connections also not shown).

The purpose of the noise shaping quantizer 316 is to quantize the LTP residual signal in a manner that weights the distortion noise created by the quantisation into less noticeable parts of the frequency spectrum, e.g. where the human ear is more tolerant to noise and/or where the speech energy is high so that the relative effect of the noise is less.

In operation, all gains and filter coefficients and gains are updated for every subframe, except for the LPC coefficients, which are updated once per frame. The noise shaping quantizer 316 generates a quantized output signal that is identical to the output signal ultimately generated in the decoder. The input signal is subtracted from this quantized output signal at the second subtraction stage 416 to obtain the quantization error signal d(n). The quantization error signal is input to a shaping filter 412, described in detail later. The output of the shaping filter 412 is added to the input signal at the first addition stage 402 in order to effect the spectral shaping of the quantization noise. From the resulting signal, the output of the prediction filter 414, described in detail below, is subtracted at the first subtraction stage 404 to create a residual signal. The residual signal is multiplied at the first amplifier 406 by the inverse quantized quantization gain from the noise shaping analysis block 314, and input to the scalar quantizer 408. The quantization indices of the scalar quantizer 408 represent an excitation signal that is input to the arithmetically encoder 318. The scalar quantizer 408 also outputs a quantization signal, which is multiplied at the second amplifier 409 by the quantized quantization gain from the noise shaping analysis block 314 to create an excitation signal. The output of the prediction filter 414 is added at the second addition stage to the excitation signal to form the quantized output signal. The quantized output signal is input to the prediction filter 414.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is its output.

The shaping filter 412 inputs the quantization error signal d(n) to a short-term shaping filter 424, which uses the short-term shaping coefficients $a_{shape,i}$ to create a short-term shaping signal $s_{short}(n)$, according to the formula:

$$s_{short}(n) = \sum_{i=1}^{16} d(n-i)a_{shape,i}.$$

The short-term shaping signal is subtracted at the third addition stage 422 from the quantization error signal to create a shaping residual signal f(n). The shaping residual signal is input to a long-term shaping filter 420 which uses the long-term shaping coefficients $b_{shape,i}$ to create a long-term shaping signal $s_{long}(n)$, according to the formula:

$$s_{long}(n) = \sum_{i=-2}^{2} f(n-lag-i)b_{shape,i}.$$

The short-term and long-term shaping signals are added together at the third addition stage 418 to create the shaping filter output signal.

The prediction filter 414 inputs the quantized output signal y(n) to a short-term prediction filter 432, which uses the quantized LPC coefficients $a_i$ to create a short-term prediction signal $p_{short}(n)$, according to the formula:

$$p_{short}(n) = \sum_{i=1}^{16} y(n-i)a_i.$$

The short-term prediction signal is subtracted at the fourth subtraction stage 430 from the quantized output signal to create an LPC excitation signal $e_{LPC}(n)$. The LPC excitation signal is input to a long-term prediction filter 428 which uses the quantized long-term prediction coefficients $b_Q$ to create a long-term prediction signal $p_{long}(n)$, according to the formula:

$$p_{long}(n) = \sum_{i=-2}^{2} e_{LPC}(n-lag-i)b_Q(i).$$

The short-term prediction residual signal r(n) is stored in an LTP buffer of length at least equal to the maximum pitch lag of 288 plus 2. The signal contained within the LTP buffer is the LTP filter state.

The short-term and long-term prediction signals are added together at the fourth addition stage 426 to create the prediction filter output signal.

The LSF indices, LTP indices, quantization gains indices, pitch lags and excitation quantization indices are each arithmetically encoded and multiplexed by the arithmetic encoder 318 to create the payload bitstream. The arithmetic encoder 318 uses a look-up table with probability values for each index. The look-up tables are created by running a database of speech training signals and measuring frequencies of each of the index values. The frequencies are translated into probabilities through a normalization step.

Figure 5:
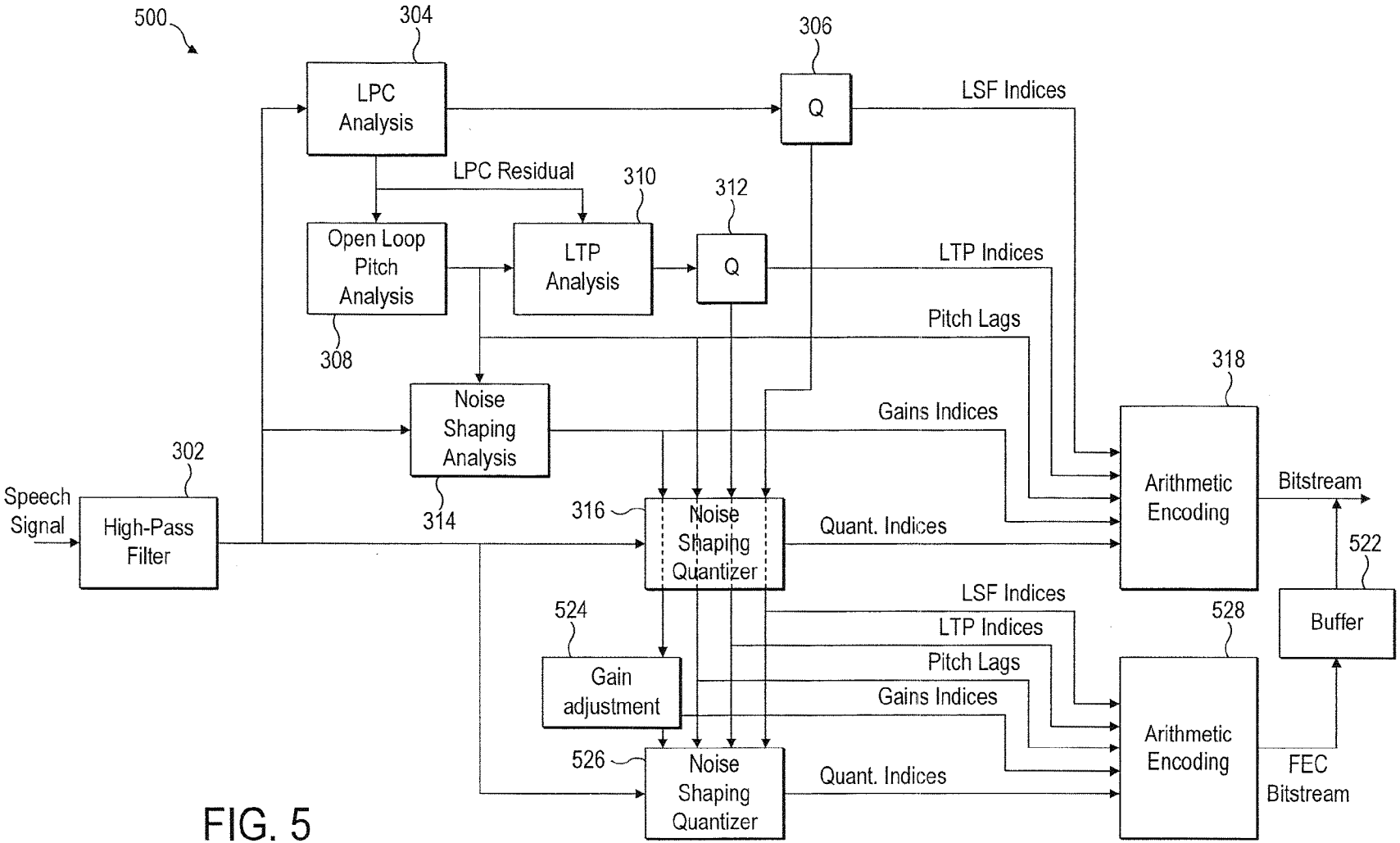
FIG. 5 shows an encoder in accordance with an embodiment of the invention.

FIG. 5 shows an encoder 500 according to an embodiment of the invention. The encoder 500 is similar to the encoder of FIG. 3, and further comprises a gain adjustment block 524, a second noise shaping quantizer 526, a second arithmetic encoding block 528, and a buffer 522. The second noise shaping quantizer 526 may have the same structure as shown in FIG. 4.

Further to the arrangement of FIG. 3, the output of the high pass filter 302 is coupled to an input of the second noise shaping quantizer 526. The output of the noise shaping analysis block 314 is further coupled to an input of the gain adjustment block 524, as signified by the dotted lines in FIG. 5. The gain adjustment block has an output coupled to an input of the second noise shaping quantizer 526, and also to an input of the second arithmetic encoding block 528. The outputs of the first and second vector quantizers 306, 312 and the open loop pitch analysis block 308 are coupled to further inputs of the second noise shaping quantizer 526, and also to the second arithmetic encoding block 528.

The second noise shaping quantizer 526 has an output coupled to a further input of the second arithmetic encoder 528. The second arithmetic encoder 528 has an output coupled to an input of buffer 522 which has an output coupled to the output bitstream.

In operation, the LSF indices, LTP indices, and pitch lags input to the first noise shaping quantizer are also input to the second noise shaping quantizer 526, and to the second arithmetic encoding block 528. The quantization gains received by the first noise shaping quantizer 316 are also input to the gain adjustment block 524.

The gain adjustment block adjusts the quantization gains such that the rate of the redundant information is lowered compared to the main encoding. The gain determines the coarseness of the residual quantization, and thus governs the trade-off between rate and distortion. The gain adjustment is made dependent on the loss rate and the signal type, and is optimized/tuned in order to give the best rate-distortion trade-off, given the loss rate. At low loss rates the redundant information rate is reduced, by increasing the gains as compared to the gains used at a high loss rate.

The adjusted gains are output to the second noise shaping quantizer 526 and also to the second arithmetic encoding block 528. The second noise shaping quantizer 526 receives the high-pass filtered input speech signal, and uses the adjusted quantization gains, along with the remaining parameters used for the encoding of the main bit stream, to generate quantization indices for the FEC data.

Hereafter, all the parameters are arithmetically encoded in the second arithmetic encoding block 528, in the same way as for generating the main bit stream, to generate the FEC bit stream. The output FEC bitstream generated for payload n is buffered in the buffer 522 in order to piggyback it to the bitstream for payload n+1 or payload n+2.

For bursty loss channels, that is channels for which consecutive packet losses are likely, it is advantageous to use the latter (n+2) approach in order to be able to correct more losses: given that packet n was lost, packet n+2 is more likely to be received than packet n+1. For channels with loss patterns that are not bursty, the first approach (n+1) may be used to keep the delay low. A flag is encoded into the main bitstream to indicate if FEC is added and at what delay the FEC information has been added. This flag has three values: One for indicating no FEC, one for FEC with a delay of 1 packet and one for FEC with a delay of 2 packets.

The parameter estimation and quantization blocks are often complexity intense, so the significant reductions in complexity are possible by performing these analyses only once for each frame in order to generate both the main bitstream and the FEC bitstream.

The encoder may comprise a further module, not shown in FIG. 5, that decides for which frames to add in-band FEC based on the signal's sensitivity to packet losses. It is known that for some signal types packet loss concealment is more effective than for other types. Packet losses in silent parts are the easiest to conceal. Packet losses in stationary voiced and unvoiced parts (smooth energy, pitch and signal envelopes) are also relative easy to conceal, whereas packet losses in un-stationary signals (such as onsets and transients) are harder to conceal.

In some embodiments a voice activity measure from the voice activity detector is used to decide when to add in-band FEC. Advantageously, an LTP sensitivity measure may also be used, where the LTP sensitivity measure is high for frames that are likely to give high error propagation when lost. This happens during unstable voiced periods, onsets etc. The LTP sensitivity measure is calculated as:

$$s=0.5\cdot PG_{LTP}+0.5\cdot PG_{LTP,HP}$$

Where $PG_{LTP}$ is the long-term prediction gain, as measured as ratio of the energy of LPC residual $r_{LPC}$ and LTP residual $r_{LPC}$, and $PG_{LTP,HP}$ is a signal obtained by running $PG_{LTP}$ through a first order high-pass filter according to $$PG_{LTP,HP}(n)=PG_{LTP}(n)-PG_{LTP}(n-1)+0.5\cdot PG_{LTP,HP}(n-1)$$

The sensitivity measure s is thus a combination of the LTP prediction gain and a high pass version of the LTP prediction gain. The LTP prediction gain is chosen because it directly relates the LTP state error with the output signal error. The high pass part is added to put emphasis on signal changes. A changing signal has high risk of giving severe error propagation because the LTP state in encoder and decoder will most likely be very different, after a packet loss A combination of the voice activity and LTP sensitivity measures is compared to a threshold for when to use in-band FEC. The threshold is dependent on the loss rate, such that more frames are protected with in-band FEC when the loss rate is high.

When a frame is not classified sensitive enough to get in-band FEC the in-band FEC blocks are bypassed.

Similar methods can be used with other codecs. For example, in a CELP type codec the pitch and LPC computation and quantization can be reused whereas the bitrate is lowered by reducing the number of pulses used in the fixed codebook.

Figure 6:
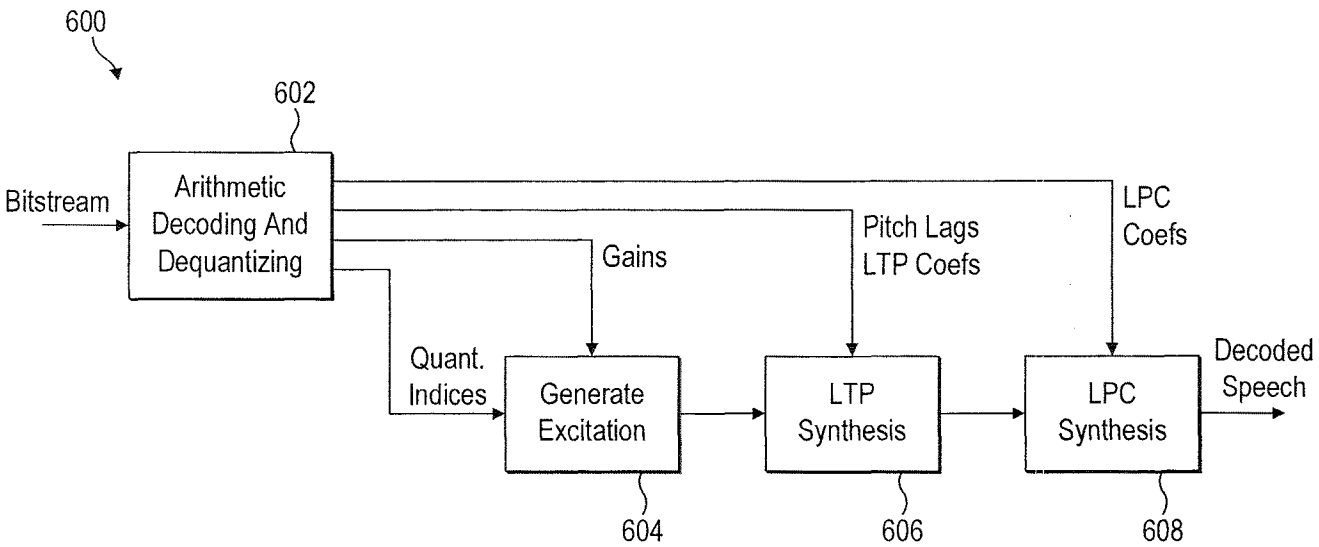
FIG. 6 shows a decoder for decoding an encoded speech signal.

An example decoder 600 for use in decoding a signal encoded by the encoder of FIG. 3 is now described in relation to FIG. 6.

The decoder 600 comprises an arithmetic decoding and dequantizing block 602, an excitation generation block 604, an LTP synthesis filter 606, and an LPC synthesis filter 608. The arithmetic decoding and dequantizing block 602 has an input arranged to receive an encoded bitstream from an input device such as a wired modem or wireless transceiver, and has outputs coupled to inputs of each of the excitation generation block 604, LTP synthesis filter 606 and LPC synthesis filter 608. The excitation generation block 604 has an output coupled to an input of the LTP synthesis filter 606, and the LTP synthesis block 606 has an output connected to an input of the LPC synthesis filter 608. The LPC synthesis filter has an output arranged to provide a decoded output for supply to an output device such as a speaker or headphones.

At the arithmetic decoding and dequantizing block 602, the arithmetically encoded bitstream is demultiplexed and decoded to create LSF indices, LTP indices, quantization gains indices, pitch lags, LTP scale value and a signal of excitation quantization indices. The LSF indices are converted to quantized LSFs by adding the codebook vectors, one from each of the ten stages of the MSVQ. The quantized LSFs are then transformed to quantized LPC coefficients. The LTP indices and gains indices are converted to quantized LTP coefficients and quantization gains, through look ups in the quantization codebooks.

At the excitation generation block, the excitation quantization indices signal is multiplied by the quantization gain to create an excitation signal e(n).

The excitation signal is input to the LTP synthesis filter 606 to create the LPC excitation signal $e_{itp}(n)$ according to:

$$e_{LTP}(n) = e(n) + \sum_{i=-2}^{2} e(n - lag - i)b_Q(i),$$

using the pitch lag and quantized LTP coefficients bQ.

The excitation signal e(n) is stored in an LTP buffer of length at least equal to the maximum pitch lag of 288, plus 2. The signal contained in the LTP buffer is the LTP filter state.

The long term excitation signal is input to the LPC synthesis filter to create the decoded speech signal y(n) according to:

$$y(n) = e_{LPC}(n) + \sum_{i=1}^{16} e_{LPC}(n - i)a_Q(i),$$

using the quantized LPC coefficients $a_Q$.

Figure 7:
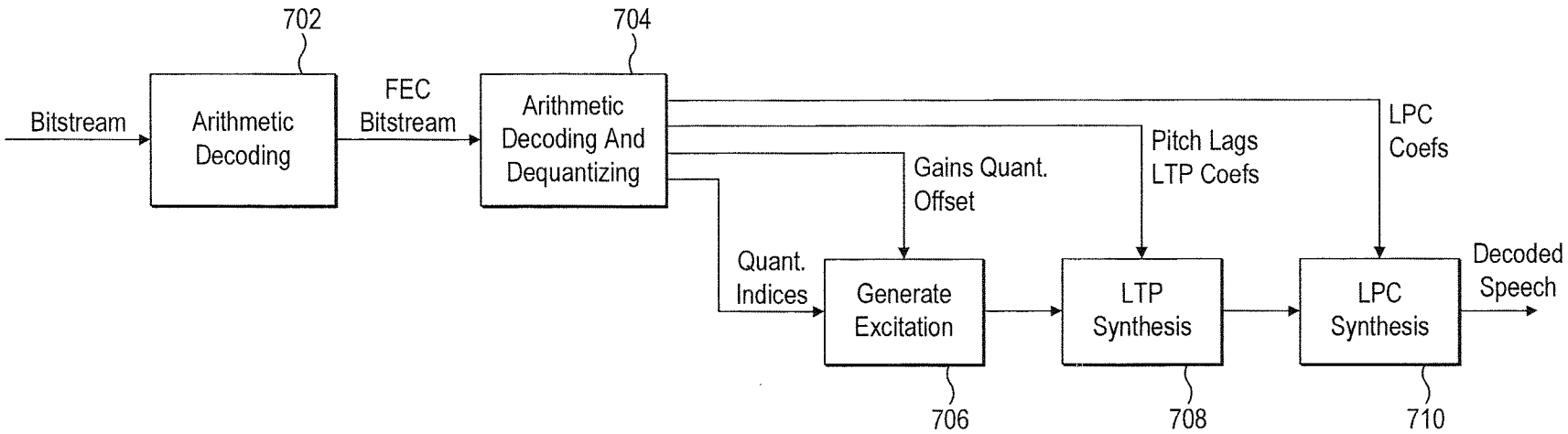
FIG. 7 shows a decoder operating to decode an encoded speech signal with in-band FEC.

FIG. 7 shows a block diagram for the operation of a decoder for use in decoding a signal encoded with in-band FEC when a packet has been lost, according to an embodiment of the invention. The decoder of FIG. 7 is similar to the decoder of FIG. 6, but further comprises an arithmetic decoding block 702.

When a packet, n−1 or n−2, has been lost and packet n has been received at the decoder, the bitstream of the future packet is decoded in the arithmetic decoder. After the parameters for the main encoding has been decoded, the arithmetic decoding block decodes the flag that indicates if the packet contains FEC data for packet n−1, n−2, or has no FEC data. If the packet contains FEC data for the lost packet, the remaining bits of the original bitstream are identified as the FEC bitstream and are decoded with the normal decoder procedure. If it is determined that none of the future packets contain useable FEC data for the lost packet, normal packet loss concealment is performed.

The encoder 500 and decoder 700 are preferably implemented in software, such that each of the components 502 to 518, and 402 to 406, and 702, 602 to 606 comprise modules of software stored on one or more memory devices and executed on a processor. A preferred application of the present invention is to encode speech for transmission over a packet-based network such as the Internet, preferably using a peer-to-peer (P2P) system implemented over the Internet, for example as part of a live call such as a Voice over IP (VoIP) call. In this case, the encoder 600 and decoder 900 are preferably implemented in client application software executed on end-user terminals of two users communicating over the P2P system.

By re-using the computational results for encoding the speech signal to generate FEC information for the speech signal, some embodiments of the invention may overcome the complexity issues associated with prior art media specific FEC techniques that require two encoders operating concurrently. Specifically, some embodiments of the invention reuse the outcome of the encoder analysis that produces the parameters for the side information. As a result only the residual signal needs to be quantized again to generate the FEC data.

Furthermore, according to some embodiments, complexity is further reduced on the receiving side, as only one decoder is required to receive and decode an encoded speech signal containing in-band FEC data encoded according to some embodiments of the invention.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. A method of providing error correction data for encoding a speech signal, the method comprising:

receiving a speech signal comprising successive frames;

for each of a plurality of frames of the speech signal:

analysing the speech signal to determine side information and a residual signal; and encoding, by an encoder, a version of the residual signal at a first bit rate, and generating an output bitstream based on the version of the residual signal encoded at the first bit rate;

for at least one of the plurality of frames of the speech signal, encoding the version of the residual signal at a second bit rate that is lower than the first bit rate;

generating an error correction bitstream based on the version of the residual signal encoded at the second bit rate; and transmitting the output bitstream and the error correction bitstream as part of a voice communication.

2. The method of claim 1 wherein the output bitstream is further based on the side information.

3. The method of claim 1 wherein the error correction data is further based on the side information.

4. The method of claim 1, wherein the residual signal encoded at the second bit rate is encoded by adjusting quantization gains such that a rate of redundant information between the residual signal encoded at the first bit rate and the residual signal encoded at the second bit rate is reduced.

5. The method of claim 1, further comprising buffering the error correction bitstream, such that the error correction bit stream is delayed relative to the output bitstream.

6. The method of claim 5, wherein the error correction bitstream is delayed by one of one packet or two packets of the output bitstream.

7. The method of claim 6 further comprising setting a flag for at least one frame of the speech signal, the flag indicating whether error correction data has been generated for that frame, the flag further indicating whether the error correction bit stream has been delayed by one or two packets.

8. The method of claim 5, wherein the delayed error correction bitstream is multiplexed with the output bitstream prior to transmission.

9. The method of claim 1, further comprising, for each frame of the speech signal, determining the sensitivity of the frame to packet losses, and generating error correction data in dependence on the determination.

10. The method of claim 9 wherein said determining comprises determining the sensitivity of the frame to packet losses based on a voice activity measure.

11. The method of claim 9 where said determining comprises determining the sensitivity of the frame to packet losses based on a long-term prediction sensitivity measure.

12. The method of claim 9, wherein if the frame is determined not to be sensitive to packet losses, generating the error correction data is bypassed.

13. The method of claim 1 further comprising controlling the quantization gain used to encode the residual information at the second bit rate in order to control the second bit rate.

14. A method of decoding an encoded bitstream, comprising:

receiving the encoded bitstream, the encoded bitstream including:

an output bitstream representing speech data and including a version of a residual signal encoded at a first bit rate; and error correction data including the version of the residual signal encoded at a second bit rate lower than the first bit rate;

decoding the speech signal output bitstream to reveal the speech data;

when it is determined that a packet of the output bitstream has been lost, determining whether error correction data for the lost packet is present in a further packet of the encoded bitstream, and if so, decoding the further packet via a decoder to reveal the error correction data for the lost packet.

15. The method of claim 14 further comprising decoding a flag in the further packet of the encoded bit stream, the flag indicating that the further packet includes the error correction data for the lost packet.

16. An encoder for encoding a speech signal including error correction data, the encoder comprising:

an input arranged to receive the speech signal as successive frames of speech data;

a first signal-processing module configured to encode a version of a residual signal of the speech signal at a first bit rate;

a first arithmetic encoder configured to generate an output bitstream based on the version of the residual signal encoded at the first bit rate; and a second signal-processing module configured to encode the version of the residual signal at a second bit rate that is lower than the first bit rate, and to generate error correction data based on the residual signal encoded at the second bit rate.

17. The encoder of claim 16 further comprising a second arithmetic encoder configured to generate an error correction bitstream based on the error correction data.

18. The encoder of claim 17 further comprising a buffer configured to delay transmission of the error correction bitstream relative to transmission of the output bit stream.

19. The encoder of claim 18 wherein the buffer is configured to delay the error correction bitstream by one of one or two packets of the output bitstream.

20. The encoder of claim 16 further comprising a gain adjustment module configured to control quantization gain used to encode the residual information at the second bit rate to thereby control the second bit rate.

21. The encoder of claim 16 wherein the second signal-processing module is further configured to, for each frame of a speech signal, determine the sensitivity of the frame to packet losses and to generate the error correction data in dependence on the determined sensitivity.

22. At least one memory device storing computer-executable instructions that, when executed, cause a computing device to perform operations comprising:

receiving a packetized bitstream that represents a speech signal, the packetized bitstream including a version of a residual signal encoded at a first bit rate, and error correction data that includes at least a portion of the version of the residual signal encoded at a second bit rate that is lower than the first bit rate;

extracting the residual signal;

detecting if a packet of the packetized bitstream has been lost, and if so, determine whether the error correction data includes error correction data for the lost packet; and decoding the speech signal from the residual signal, and decoding the error correction data for the lost packet in an event that it is determined that the error correction data for the lost packet is present.

23. The at least one memory device of claim 22, wherein the operations further comprise, for each packet of the packetized bit stream, decoding a flag indicating whether the packet contains error correction data for a lost packet.

24. At least one memory device storing a computer program product, the program comprising code arranged so as when executed on a processor to cause a device to:

receive a speech signal comprising successive frames;

for each of a plurality of frames of the speech signal:

analyse the speech signal to determine side information and a residual signal;

encode a version of the residual signal at a first bit rate, and generate an output bitstream based on the residual signal encoded at the first bit rate; and for at least one of the plurality of frames of the speech signal, encode the version of the residual signal at a second bit rate that is lower than the first bit rate; and generate error correction data based on the residual signal encoded at the second bit rate.

25. A communication system comprising at least one end-user terminal, the end-user terminal comprising:

an encoder including:

an input arranged to receive a first speech signal comprising successive frames;

a first signal-processing module configured to encode a version of a residual signal of the speech signal at a first bit rate;

a first arithmetic encoder configured to generate an output bitstream based on the residual signal encoded at the first bit rate; and a second signal-processing module configured to encode at least a portion of the version of the residual signal at a second bit rate that is lower than the first bit rate, and to generate error correction data based on the version of the residual signal encoded at the second bit rate, the encoder being configured to generate a first packetized bitstream that includes the output bitstream and the error correction data;

a decoder including:

an input module configured to:

receive a second packetized bitstream and extract a second output bitstream from the second packetized bitstream; and detect if a packet of the second packetized bitstream has been lost, and if so, determine whether error correction data for the lost packet is present in a further packet of the second packetized bitstream; and a signal-processing module configured to decode a second speech signal from the second output bitstream, and to decode the error correction data for the lost packet if it is determined that the error correction data for the lost packet is present.

* * * * *